US005647632A

United States Patent [19]

Fireman

[11] Patent Number: 5,647,632

[45] Date of Patent: Jul. 15, 1997

[54] CHAIR CONVERTIBLE TO BENCH OR SETTEE

[76] Inventor: Barry N. Fireman, 434 Warick Rd., Wynnewood, Pa. 19096

[21] Appl. No.: 543,637

[22] Filed: Oct. 16, 1995

[51] Int. Cl.[6] ..... A47C 13/00

[52] U.S. Cl. ..... 297/109; 297/118; 297/283.1

[58] Field of Search ..... 297/118, 108–110, 297/233, 234, 240, 283.2, 378.1, 283.1

[56] References Cited

U.S. PATENT DOCUMENTS

| | | | |
|---|---|---|---|
| 68,973 | 9/1867 | Gerdon, Jr. . | |
| 117,565 | 8/1871 | Pitcher | 297/109 |
| 212,778 | 2/1879 | Woolverton | 297/233 X |
| 259,953 | 6/1882 | Welsh et al. | 297/108 X |
| 324,661 | 8/1885 | Crandall | 297/109 X |
| 918,706 | 4/1909 | Sanders . | |
| 986,686 | 3/1911 | Carney . | |
| 1,309,097 | 7/1919 | Marwick . | |
| 1,335,973 | 4/1920 | Kesselman | 297/233 X |
| 1,377,868 | 5/1921 | Bezold . | |
| 1,817,708 | 8/1931 | Pintow | 297/110 |
| 1,926,915 | 9/1933 | Ramirez | 297/109 |
| 2,620,018 | 12/1952 | Pagano . | |
| 3,873,114 | 3/1975 | Brown | 297/118 X |

FOREIGN PATENT DOCUMENTS

| | | | |
|---|---|---|---|
| 1130123 | 4/1952 | Germany | 297/233 |

*Primary Examiner*—Milton Nelson, Jr.
*Attorney, Agent, or Firm*—Reed Smith Shaw & McClay

[57] ABSTRACT

A convertible chair includes a base platform, a seat assembly hingedly coupled to the base assembly and respective back support panels hingedly coupled to the base assembly and seat assembly, the chair being convertible, selectively, to a flat topped bench or coffee table, or to a settee.

3 Claims, 3 Drawing Sheets

CHAIR CONVERTIBLE TO BENCH OR SETTEE

BACKGROUND OF THE INVENTION

This invention relates to furniture, and more particularly, to furniture whose construction is such that it may readily be converted from one useful configuration to another. Specifically, this invention relates to a chair, aesthetically pleasing and nearly conventional in its outward appearance, but convertible by simple manipulative steps, without disassembly, to configurations in which it provides a bench or cocktail table, or to a settee.

Chairs convertible to other operative configurations have heretofore been proposed. For example, in U.S. Pat. No. 918,706, to A. Sanders, issued Apr. 20, 1909, a chair was disclosed, which could be used, according to its specification, as an ordinary single seat chair, or unfolded for use as a bench or to form a settee accommodating two persons. U.S. Pat. No. 1,377,868, to J. Bezold, issued May 10, 1921, disclosed a chair convertible to a combination chair and desk, or to a crib or bed. Other forms of convertible chairs have also been proposed.

SUMMARY OF THE INVENTION

The present invention provides a chair convertible to a bench or cocktail table or to a settee, and providing back supports in the settee configuration.

A chair in accordance with the present invention has a component which may be referred to as a base platform, which includes conventional floor or ground-engaging support. Hinged to the base platform is a seat assembly which provides a seat member and a seat back coupled to the seat member. The base platform and seat assembly are so connected that selective rotation of the seat assembly relative to the base platform can invert the seat assembly, so that the seat back provides, in effect, a ground supporting leg for the seat member. In such a configuration, the bottom of the seat member and a portion of the base platform form the upper, or seat, surface of a bench or settee, or the top of a cocktail table.

In accordance with the invention, the thus-formed bench or table can be used in the above configuration, but the invention also provides to its user the added benefit of having selectively usable back panels associated with the bench, available to convert the bench or table into a settee.

DESCRIPTION OF THE DRAWINGS

There is seen in the drawings a form of the invention which is presently preferred and which constitutes the best mode contemplated for carrying the invention into effect. It should be understood, however, that the invention is not limited to the precise arrangements and instrumentality shown.

DESCRIPTION OF PREFERRED EMBODIMENT

Figure 1:
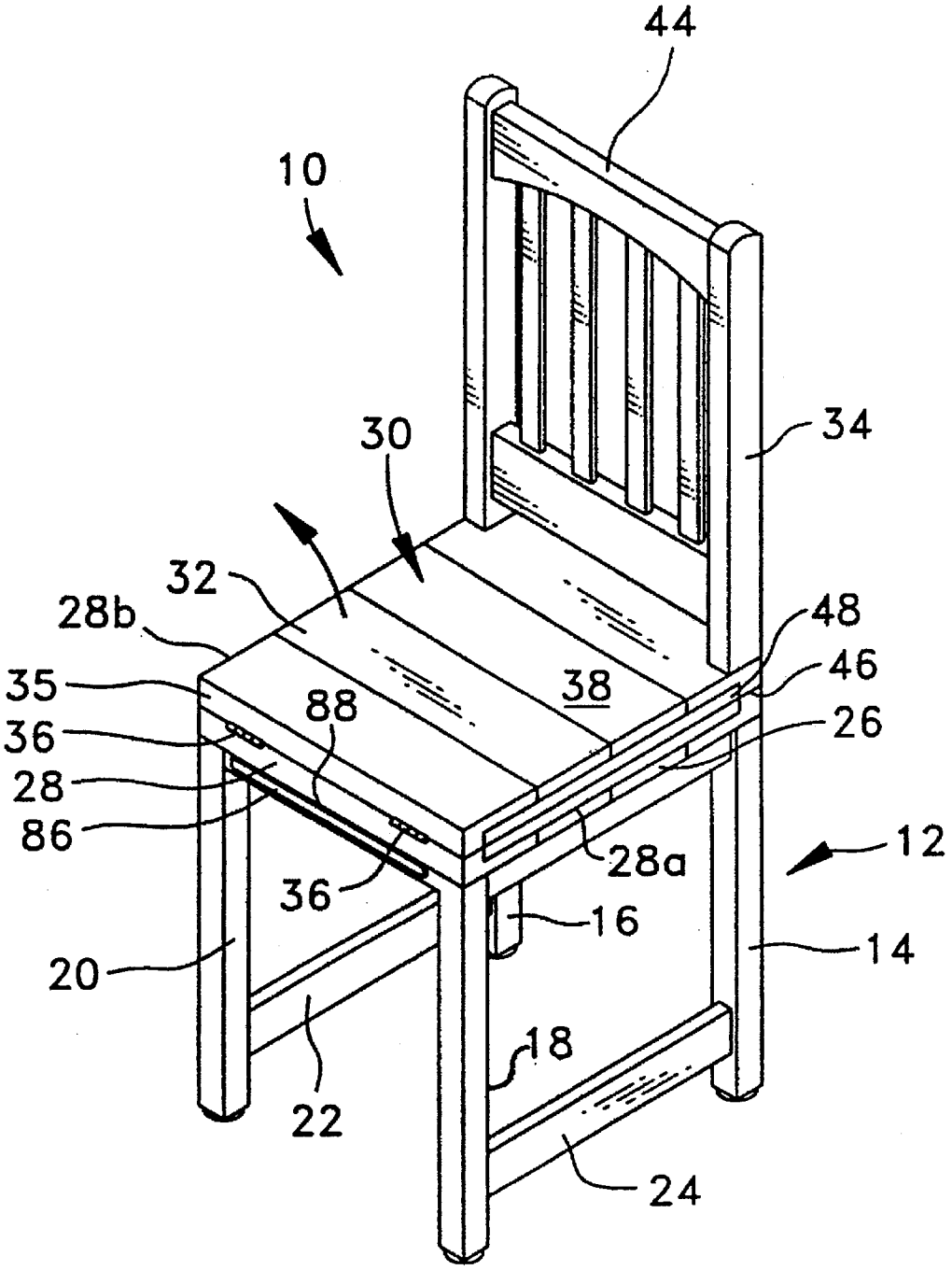
FIG. 1 is a perspective view of an article in accordance with the invention, in its chair-forming configuration.

Referring now to the drawings in detail, in which like reference numerals indicate like elements, a preferred embodiment will now be described in detail.

Referring first to FIG. 1, there is seen a convertible chair, designated generally by the reference numeral 10. The chair 10 comprises a base platform, designated generally by the reference numeral 12. The base platform 12 in the illustrated embodiment includes suitable ground supports in the form of legs 14,16,18,20 which may have associated with them suitable braces 22, 24 or stretchers or cross-braces (not shown) of configurations which will occur to those skilled in the art. Those skilled in the art will also appreciate that ground support configurations other than the illustrated individual legs 14,16,18,20 may be used. For example, the ground support might, if desired, take the form of a pedestal or other configuration familiar in chairs.

The base platform 12 provides a generally horizontal upper surface 26, which may be said for the purpose of further description to have a first edge portion 28 and a spaced pair of side edge portions **28*a* and 28*b***.

Associated with the base platform 12 is what may conveniently be referred to as a seat assembly 30. The seat assembly 30 comprises a seat member 32, to which a seat back member 34 is coupled. When the chair 10 is in its chair-forming configuration, the seat assembly 30 overlies and is supported by the base platform 12, and the overall appearance of the convertible chair 10 is generally that of a conventional chair. The seat assembly 30 in the illustrated embodiment has a first edge portion 35, pivotably connected to the above-mentioned first edge portion 28, as by hinges 36. Those skilled in the art will appreciate that many hinges of conventional and unconventional type may be used for the present purposes. For example, the hinge 36 may be a so-called "piano" hinge, characterized by a large number of interfitting axially aligned loops through which a continuous hinge pin passes. Other suitable hinges will occur to those skilled in the art.

The seat member 32, for purposes of the following description, may be said to have, respectively, an upper surface 38 and a lower surface 40. When the seat member 32 overlies the base platform 12 in the chair-forming configuration, the lower surface 40 of the seat member 30 overlies and is juxtaposed to the horizontal upper surface 26 of the base platform 12.

Figure 2:
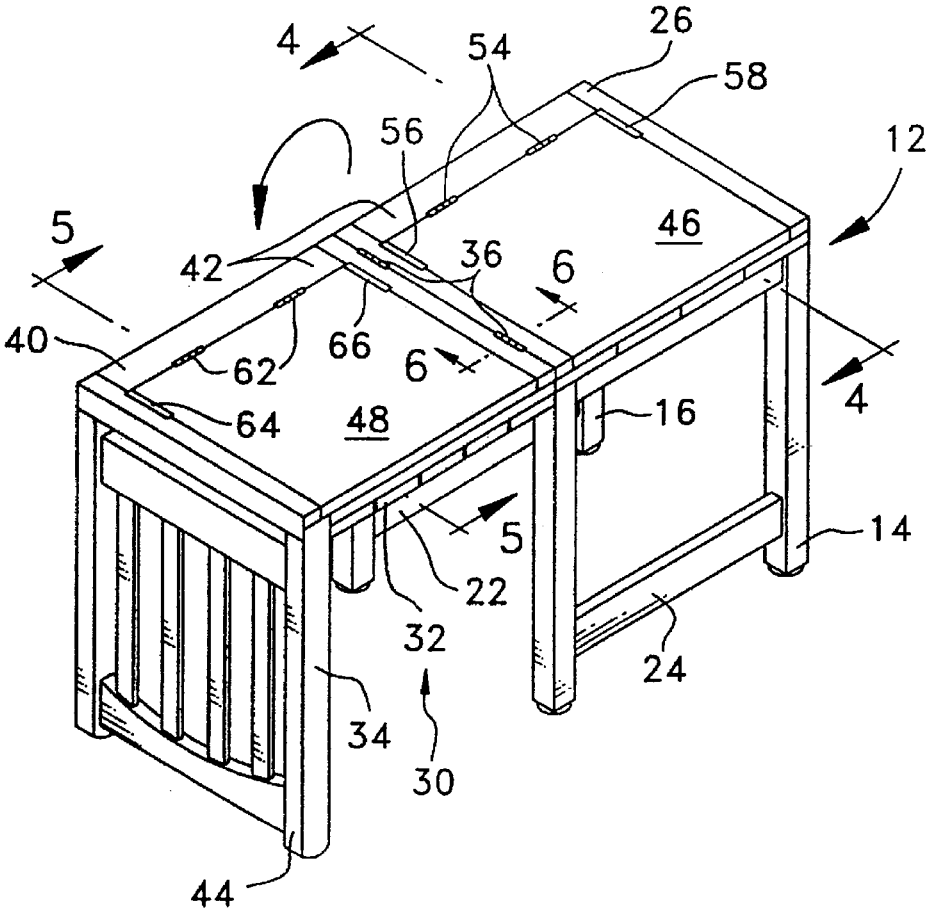
FIG. 2 is a perspective view of an article in accordance with the invention, in its bench or table configuration.

Referring now to FIG. 2, the convertible chair is shown in a second configuration, in which the base platform 12 and seat assembly 30 form a bench or cocktail table. In FIG. 2, the seat assembly 30 is rotated 180° from the position in which it is depicted in FIG. 1. The lower surface 40 of the seat member 32 and the upper surface 26 of the base platform 12 are generally "coplanar" and form a continuous bench or top surface 42 which may serve for seating or other purposes. With the seat assembly 30 thus disposed, an upper edge 44 of the seat back member 34 contacts the support surface (floor or ground), and serves as a ground support for the seat assembly 30 in its second position.

Figure 3:
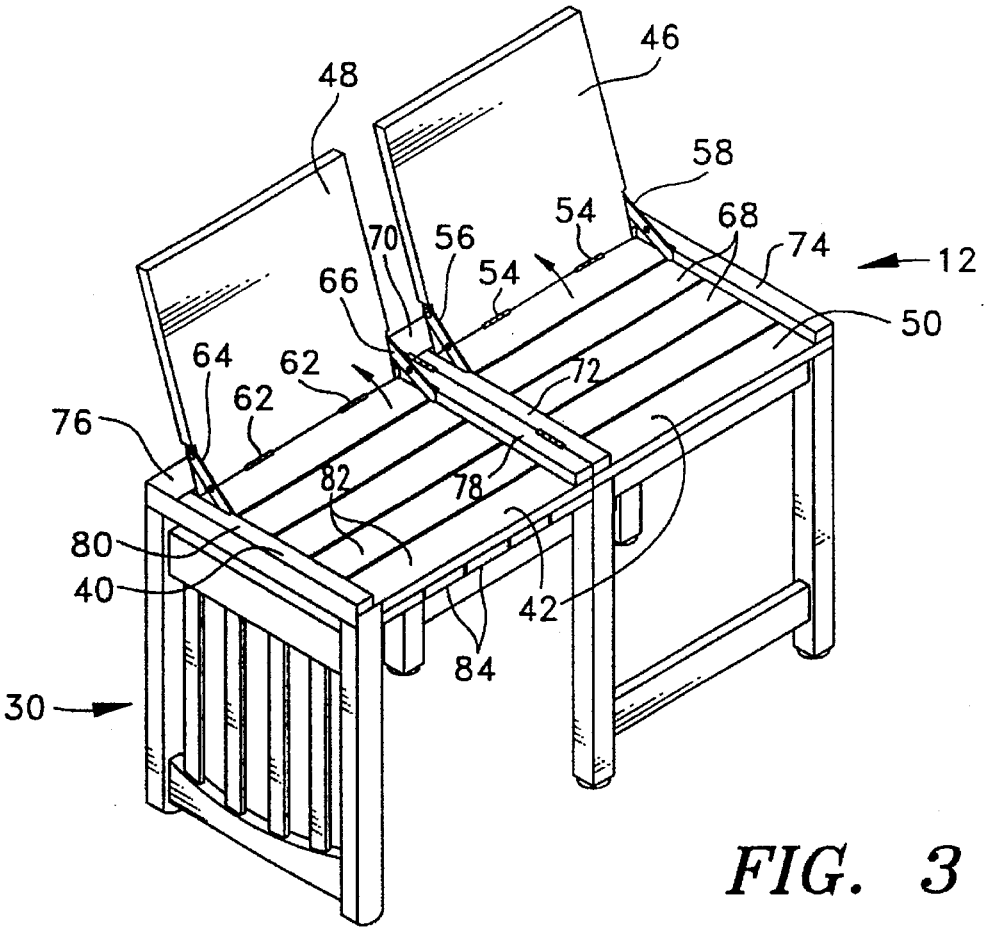
FIG. 3 is an article in accordance with the invention, disposed in its configuration with back rests deployed to form a settee.
Figure 4:
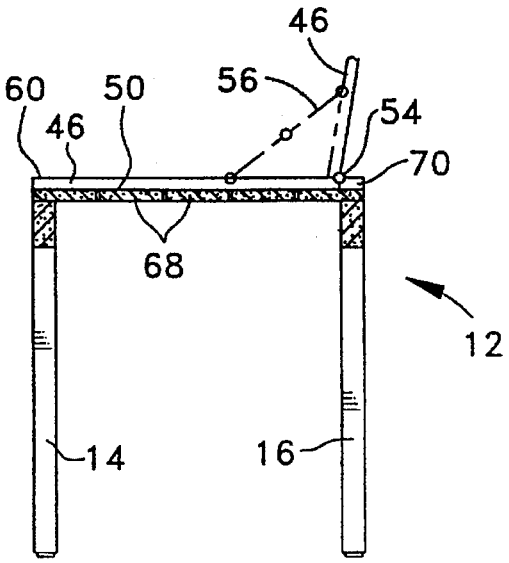
FIG. 4 is a cross-sectional view taken along the line 4—4 in FIG. 2.
Figure 5:
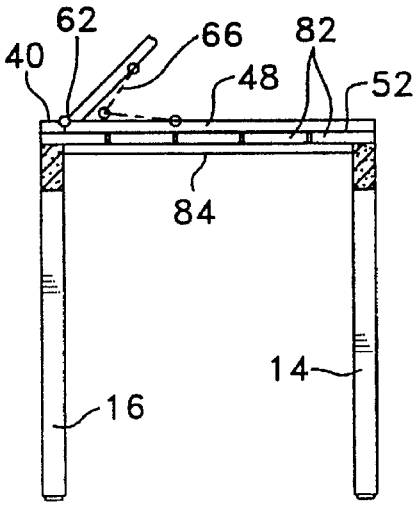
FIG. 5 is a cross-sectional view taken along the line 5—5 in FIG. 2.

Referring now to FIGS. 3, 4 and 5, the manner in which the article of the present invention can be configured to provide a settee will be described.

Referring first to FIG. 3, operatively associated with the bench or top surface 42 are respective back support panels 46 and 48. The back support panels 46 and 48, in the illustrated form of the invention, are pivotably connected, respectively, to the horizontal upper surface 26 of the base platform 12 and the lower surface 40 of the seat member 32. The lower surface 40 of the seat member 32, it will be recalled, faces upwardly when the seat assembly 30 is disposed in the position shown in FIG. 2. Preferably, as is perhaps best seen in FIGS. 4 and 5, the back panels 46 and 48 are recessed into the surfaces 26 and 38 with which they are associated. Such a configuration minimizes the overall thickness of the members which define the upper surface 26 of the base platform 12 and the seat member 32. Referring to FIGS. 3, 4 and 5, it will be apparent that the structure of the base platform 12 is such that it provides a recess 50 into which the back support panel may be received, and the seat member 32 is provided with a recess 52 into which the back support panel 48 may be received. With the respective back support panels 46 and 48 in their recesses, the convertible chair 10 may be placed in its chair-forming position, or may be used as a flat-topped bench or coffee table as shown in FIG. 2.

Referring again to FIG. 3, and also to FIG. 4, the back support panel 46 is preferably hinged to the member defining the horizontal upper surface 26 of the base platform 12 by means of one or more suitable hinges 54, and its movement is preferably limited by suitable control braces, such as the hinged braces 56 and 58 seen in FIG. 3. As is apparent from FIGS. 2 and 3, the braces 56 and 58 are so disposed as to fold, when the back support panel 46 is in its first position, to a position in which they are flush with or below the plane of the upper surface 26 (and the bench or top surface 42). When in its first position, the back support panel 46 defines, with its surface 60, a portion of the above-described upper surface 26.

Referring to FIG. 5, the back support panel 48 is associated with the seat member 32 and its lower surface 40 in a similar manner. The back support panel 48 is connected to the seat member 32 by one or more suitable hinges 62, and its movement is limited by one or more suitable braces 64 and 66.

The braces 56, 58, 64, and 66 may be of the "over-center" type, familiar to those skilled in the art, which serve to retain the back support panels 46 and 48 in their upright positions (FIG. 3).

Those skilled in the art will appreciate that the particular hardware used to achieve the desired hinged relationship between the respective back support panels 46 and 48 and the structures to which they are hinged, and the means by which their movement is limited, are matters of design choice. The particular angular relationship between the back support panels 46 and 48 relative to their related structure is also a matter of design choice. The back support panels 46 and 48 should be rotatable at least 90° from their first to their second positions, and those skilled in the art will appreciate that for reasons of comfort and ergonomics, the angular movement between the first and second positions of the back support panels 46 and 48 is best made to be in excess of 90°.

The materials for the convertible chair 10 may be any of those ordinarily used in the manufacturer of chairs. Thus, the convertible chair 10 may be of wood (solid, veneer or ply), or such other materials as solid or foam core plastic polymers, as well as structural composites and polymer-bonded aggregates.

It will be understood that the particular dimensions of the convertible chair, as distinguished from the structural and functional interrelationship of its parts, are also matters of design choice.

In one presently preferred form of the invention, the horizontal upper surface 26 of the base platform 12 is formed by a plurality of slats 68 (FIGS. 3 and 4), and the recess 50 into which the back support panel 46 may be received is defined by respective framing strips 70, 72 and 74 of a thickness corresponding to the thickness of the back support panel 46. Similarly, the recess 52 into which the back support panel 48 may be received is defined by respective framing strips 76, 78 and 80 of a thickness corresponding to the thickness of the back support panel 48. Other suitable arrangements will occur to those skilled in the art.

In one presently preferred form of the invention, the seat member 30 is made up of a lattice of slats 82 extending in a first direction and slats 84 extending cross-wise with respect to the slats 82. Referring again to FIG. 3, it will be seen that the slats 82, which define the lower surface 40 of the seat member 30, are oriented in the same direction as the slats 68, so that in the bench and settee forming configurations, the slats providing the bench or top surface 42 extend in the same direction. Other configurations may of course be used within the spirit and scope of the invention.

Figure 6:
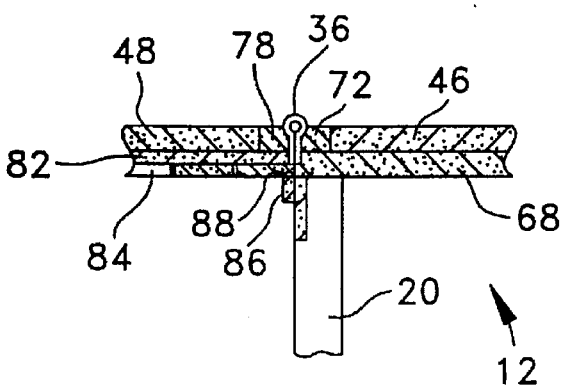
FIG. 6 is a partial cross-sectional view taken along the line 6—6 FIG. 2.

Referring now to FIGS. 1 and 6, an aspect of the structural interrelationship between the base platform 12 and the seat assembly 30 in the presently preferred form of the invention will now be described in detail. Referring first to FIG. 1, secured to the base platform 12 beneath the hinges 36 is a support rail 86, projecting outwardly from the first edge portion 28 and extending generally horizontally beneath the hinges 36. In FIG. 6, it is seen that the support rail 86 provides, in effect, a lip or support surface 88, fitting closely with and engaging the seat member 32 (and therefore the seat assembly 30) at a portion of the seat member 32 adjacent to the edge portion 35. Those skilled in the art will recognize that contact between the support surface 88 and the seat member 32 serves in large measure to relieve the hinges 36 from shear forces to which they would otherwise be subjected when weight is applied to the underside of the seat member 32 in the bench or settee configurations.

It should be understood that the present invention may be embodied in other specific forms without departing from its spirit or essential attributes. Accordingly, reference should be made to the appended claims, rather than to the foregoing specification, for an indication of the scope of the invention.

I claim:

1. A convertible chair comprising a base platform having an upper surface, a first edge portion and a spaced pair of edge portions intersecting said first edge portion; a ground support coupled to said platform; and a seat assembly, said seat assembly comprising a seat member and a seat back member coupled to said seat member, said seat member having respective upper and lower surfaces, said seat assembly being pivotably connected to said base platform for movement between a chair-forming first position in which said lower surface of said seat member overlies and is juxtaposed to said upper surface of said base platform and a second position in which said lower surface of said seat member and said upper surface of said base platform are generally coplanar so as to form a bench surface, said seat back member adapted to contact the ground so as to serve as a ground support when said seat assembly is in said second position; and a pair of foldable back support panels operatively associated with an upper seating surface, said pair of back support panels comprising a first back support panel operatively associated with said upper surface of said base platform and a second back panel operatively associated with said lower surface of said seat member, said first back support panel being pivotable from a first position in which it defines a portion of said upper surface of said base platform to a second, back supporting position, in which it extends upwardly with respect to said bench surface, said second back support panel being pivotable from a first position in which it defines a portion of said lower surface of said seat member to a second, back supporting, position, in which it extends upwardly with respect to said bench surface, and a first recess in said upper surface of said base platform, a second recess in said lower surface of said seat member, said first back support panel being received in said first recess when said first back support panel is in its first position, and said second back support panel being received in said second recess when said second back support panel is in its first position.

2. A convertible chair in accordance with claim 1, said seat member having a first edge portion, hinge means coupled to said respective first edge portions of said seat assembly and said base platform, and a support surface on said base platform adjacent to said hinge means, whereby said support surface engages said seat member when said seat assembly is in its second position.

3. A convertible chair comprising a base having a ground support, and a seat assembly comprising a seat member and a seat back member pivotably coupled to said base; said seat assembly being movable relative to said base from a chair-forming position in which said seat member overrides and is supported by said base to a bench-forming position in which said base and said seat member form a bench surface and said seat back member provides a ground support; and at least one back support panel pivotably coupled to said bench surface and pivotable from a storage position to a back supporting position when said seat assembly is in said bench-forming position; wherein said seat assembly is hingedly connected to said base for pivoting about a first axis from said chair-forming position to said bench-forming position, and said back support panel being hingedly connected to said bench surface for pivoting about a second axis from said storage position to said back supporting position, said first and second axes being generally orthogonal; a first one of said back support panels being pivotably coupled to said base and a second one of said back support panels being pivotably coupled to said seat assembly and said base having a first recess, said seat assembly having a second recess, said first one of said back support panels being received in said first recess when in a storage position and said second one of said back support panels being received in said second recess when in its storage position.

* * * * *